US007998030B2

(12) United States Patent
Wroclawsky

(10) Patent No.: US 7,998,030 B2
(45) Date of Patent: Aug. 16, 2011

(54) SPEED AND RESISTANCE APPARATUS

(76) Inventor: Sol Wroclawsky, Long Beach, CA (US)

( * ) Notice: Subject to any disclaimer, the term of this patent is extended or adjusted under 35 U.S.C. 154(b) by 0 days.

(21) Appl. No.: 12/802,771

(22) Filed: Jun. 14, 2010

(65) Prior Publication Data

US 2010/0323848 A1 Dec. 23, 2010

Related U.S. Application Data

(60) Provisional application No. 61/213,536, filed on Jun. 18, 2009.

(51) Int. Cl.
*A63B 22/00* (2006.01)

(52) U.S. Cl. ..... 482/51; 482/111; 482/124; 280/1.5

(58) Field of Classification Search ..... 482/14, 482/51, 54, 68, 74, 111, 112, 121, 124, 129, 482/148; 280/1.5, 213, 214, 810; 244/142, 244/143, 145
See application file for complete search history.

(56) References Cited

U.S. PATENT DOCUMENTS

| | | | | | |
|---|---|---|---|---|---|
| 4,197,817 | A | | 4/1980 | Crutchfield | |
| 4,469,324 | A | | 9/1984 | Dolan | |
| 5,167,601 | A | * | 12/1992 | Frappier | 482/121 |
| 5,197,931 | A | | 3/1993 | Wroclawsky | |
| 5,217,186 | A | | 6/1993 | Stewart et al. | |
| 5,377,626 | A | | 1/1995 | Kilsby et al. | |
| 5,472,394 | A | * | 12/1995 | Michaelson | 482/74 |
| 5,490,826 | A | * | 2/1996 | Rose | 482/74 |
| 6,027,001 | A | * | 2/2000 | Levitan | 224/184 |
| 6,123,649 | A | | 9/2000 | Lee et al. | |
| 6,132,346 | A | * | 10/2000 | Weeks | 482/124 |
| 6,149,559 | A | | 11/2000 | Mackey | |
| 6,652,427 | B2 | | 11/2003 | Wroclawsky | |
| 6,692,417 | B2 | | 2/2004 | Burrell | |
| 7,314,437 | B2 | | 1/2008 | Frappier | |
| 7,678,026 | B2 | * | 3/2010 | Lewis | 482/74 |
| 2006/0063651 | A1 | | 3/2006 | Sload | |
| 2006/0073955 | A1 | | 4/2006 | Garcia Lopez | |
| 2006/0199711 | A1 | | 9/2006 | Miers | |
| 2007/0213186 | A1 | | 9/2007 | Longo | |
| 2008/0108485 | A1 | | 5/2008 | Brien | |
| 2008/0174078 | A1 | * | 7/2008 | Dooley | 280/1.5 |
| 2008/0227604 | A1 | * | 9/2008 | Daniel | 482/74 |

* cited by examiner

*Primary Examiner* — Loan Thanh
*Assistant Examiner* — Tam Nguyen
(74) *Attorney, Agent, or Firm* — I. Michael Bak-Boychuk

(57) ABSTRACT

A rolling resistance producing apparatus is tethered to trail behind a person includes a longitudinally aligned fabric panel stretched on a frame which also engages the rear end of an elastomeric band that is stretched through a sheath formed in the panel to engage a harness tied to selected limbs of the person to provide resistance thereto. The trailing end of the frame is supported on a wheel to follow the person as she or he are moving. A measurement system sensing the movement of the wheel then records the rate of the movement to provide an indication of fatigue.

16 Claims, 3 Drawing Sheets

SPEED AND RESISTANCE APPARATUS

REFERENCE TO RELATED APPLICATIONS

This application obtains the benefit of the earlier filing date of U.S. Provisional Application Ser. No. 61/213,536 filed on Jun. 18, 2009.

BACKGROUND OF THE INVENTION

1. Field of the Invention

The present invention relates to an apparatus for providing resistance to the legs of an athlete while training to improve sudden movement, along with a measurement record thereof, and more particularly to a resistance and measurement system conformed to align behind the athlete during his or her accelerating movement.

2. Description of the Prior Art

Those engaged in the training of athletes for sporting endeavors that entail complex body movements may recognize the negative and deleterious effect of fatigue on the efficacy of the training program. Simply, the course of training by sheer repetition of complex or changing movements often fails to obtain the expected result since the onset of fatigue in a muscular grouping is rarely uniform and the imperceptible fatigued muscle compensation then results in all sorts of poor habits. For example, the musculature grouping of a sprinter that may be first involved in a sudden start and thereafter down the track and then the finish includes not just the large leg muscles but also various other smaller ones that control body and joint alignment, and the like, and it is manifestly unlikely that all the involved muscles will coherently tire at the same rate.

This is particularly pronounced amongst the more competitive athletes that by their dedication are constantly working out since most current exercise facilities favor just one or another large muscle group that results in an uneven muscular development in which the smaller ones are deferred to inattention. When strained by repetitive training these transient movement patterns include smaller muscles then invariably tire at a faster rate, resulting in compensatory changes which grossly distort the efficacy of further repetition, to a point where continued training may simply induce improper habits that produce a negative, rather than a positive, result.

Those skilled in the art will appreciate that while prolonged repetitive exercise is effective in the collective training of large muscular groupings, such as those of a long distance runner, the same effect is more difficult to achieve in the training of transient patterns that include those entailed in a sudden start and thereafter the movement down the track for the reasons that I note above. Thus while I and others have described in the past various training systems and mechanisms exemplified in U.S. Pat. Nos. 6,652,427 and 5,197,931 issued to me; U.S. Pat. No. 5,217,186 issued to Stewart et al.; U.S. Pat. No. 5,427,394 issued to Michaelson, and many others, each of these examples relies on training repetition as the driving mechanism for the coordinated development of the whole muscular group. The target efficacy of these mechanisms, therefore, is in the improvement in the most limiting component of the group, a result focused on the development of whole muscle array.

Unlike this coordinated development path where the exercise focus is easily determined by the total time needed to reach a finish line, the dynamics of a sudden lunge out of the starting blocks, for example, present a more difficult analytic assessment. While one may choose a point on the track to somehow quantify these transient, such a measurement alone is simply insufficient as it often hides negative habits that often manifest themselves only much further along the track.

In my prior U.S. Pat. No. 6,652,427 that I have noted above I have described a resistance arrangement useful in deploying an elastomeric restraint to the legs of an athlete while training on a treadmill in which a fabric panel stretched between the athlete and a vertical post behind the treadmill serves to guide and stabilize the stretched restraining elastomeric strap. While quite useful in inducing added effort during a steady state treadmill driven exercise, this combination provides little information, and thus little training utility, useful in the development of transient capabilities like those during all the movement patterns from the starting blocks to the finish. A restraint mechanism that produces continuous measurement information while tied to the athlete during all such transient patterns and that fully records all the parameters thereof is therefore extensively desired and it is one such a tethered measurement system that is described herein.

SUMMARY OF THE INVENTION

Accordingly, it is the general purpose and object of the present invention to provide a measurement attachment aerodynamically aligned to trail a measurement wheel behind a person while training to provide measurement signals indicative of the rate changes of the movement and the distance traversed.

Other objects of the invention are to provide a measurement system which also includes resistance inducing attachments tethered to a training athlete and also aerodynamically stabilized so as to minimize any interference in the course of the exercise.

Yet additional and further objects of the invention shall become apparent upon the inspection of the description that now follows, in conjunction with the accompanying illustrations.

Briefly, these and other objects are accomplished within the present invention by providing an exercise resistance structure attachable to the waist and upper legs of a training athlete in a manner generally similar to the attachment described in U.S. Pat. No. 6,652,427 issued earlier to me, modified however in accordance with the teachings herein. More precisely, a generally L-shaped trailing frame defined by two linear frame pieces joined to each other at an obtuse angle is releasably attached to the athlete's waist at the free end of one of the frame pieces while the end of the other piece is trailed behind the athlete on a pivotally mounted trailing roller or wheel carrying a ballast weight to increase the inertia of the structure. One or more magnets mounted in spaced increments on this trailing wheel are then each aligned to pass adjacent an inductor coil in a manner similar to that described in my co-pending U.S. patent application Ser. No. 12/661,010, which I incorporate in its entirety herein by reference, in a manner known in the art is then useful to generate periodic signals indicative of the wheel's rolling rate which can then by accumulated with time to provide an indication of the distance, the maximum rate achieved and the various combinations thereof.

A dimensionally conformed generally triangular fabric panel is then secured at two of its edges to the respective frame pieces with the third edge once again folded over to form an envelope or sheath through which an elastomeric band is stretched from the trailing end of the frame to a split harness having its ends respectively secured to the athlete's thighs. Preferably the dimensions of the frame and the included angle between its pieces are each selected such that the ground contact of the trailing wheel assembly is spaced behind the athlete's concurrent foot prints on the ground, thereby insuring a generally centered alignment of the frame behind the athlete.

To maximize this aerodynamically centralized alignment behind the athlete while he or she is moving down the track, the trailing fabric panel in the instant invention is both perforated by a plurality of openings and is also stretched to its full planform by ribs or battens that extend to its folded over free edge within which the elastomeric restraint band is stretched. Thus in the course of each of the athlete's strides a substantial fabric area is laterally moved in coordination with the leg movement that is aerodynamically attenuated towards the trailing end, resulting in a highly decreased lateral displacement of the trailing wheel assembly to thereby keep it generally centered on the course or track. The relative dimensions along with this centering tendency and the generally triangular planform result in a mechanism that presents little interference to the athlete while insuring a running leg motion that has minimal lateral components.

In this form both the aerodynamic drag and also the elastic restraint combine to impose a repeatable training resistance to the movements of the athlete while moving wholly unrestrained down the course or track. Moreover, since the source of these repeatable restraining loads is trailed directly behind the athlete in the course of the lunge or sudden start, the mechanism is also useful as a reliable measurement tool by which the troubling aspects of localized muscular fatigue can be discerned and avoided. Notably, this same trailing structure also aligns the restraining forces along the movement path, thereby limiting unwanted lateral leg movement components while reinforcing the movements in a plane along the running path. Of course, one will further appreciate that these same motion aligning aspects are useful not only in the training of a sprinter but also in other competitive events like skating or walking in which all unnecessary muscular movements only detract from the result.

DESCRIPTION OF THE PREFERRED EMBODIMENT

Figure 1:
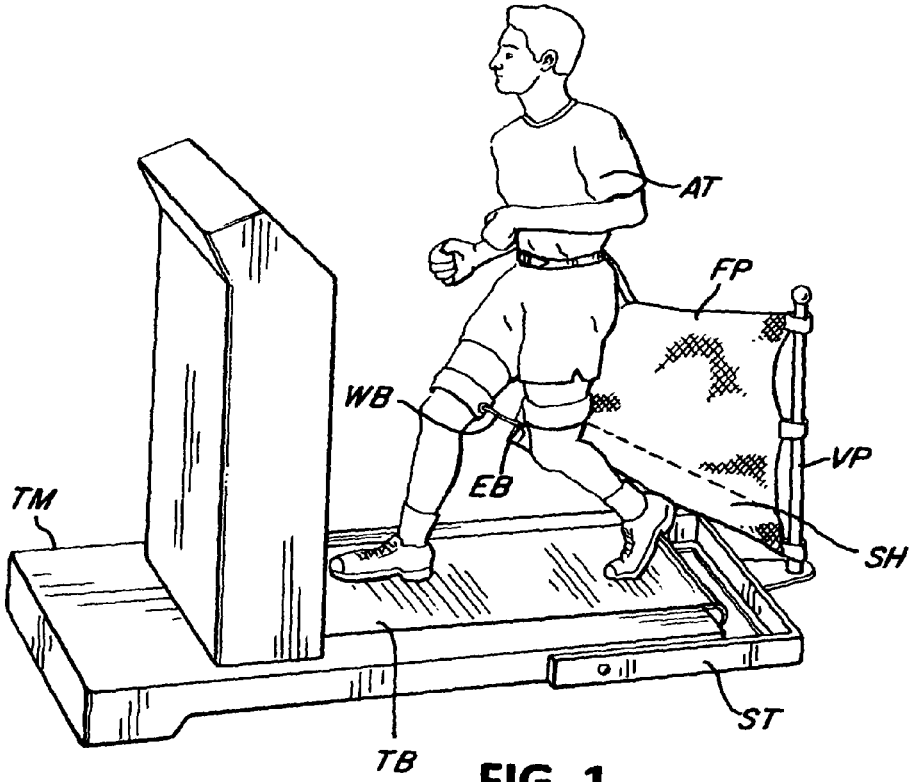
FIG. 1 Prior Art
FIG. 1 is a perspective illustration of my earlier treadmill resistance apparatus invention described in U.S. Pat. No. 6,652,427 issued on Nov. 25, 2003, and designated herein as PRIOR ART.

In my prior U.S. Pat. No. 6,652,427 issued to me on Nov. 25, 2003, I have described a treadmill resistance apparatus, which I now generally summarize by reference to FIG. 1 captioned as 'PRIOR ART' describing a structure ST attachable at the rear of a treadmill TM to deploy a vertical post VP behind the end of the treadmill belt TB. One edge of a fabric panel FP, tethered at the other edge from the waist of an athlete or user AT training on the treadmill, is attached to the post to suspend a folded lower edge sheath or pocket SH in which an elastomeric band EB is stretched from the base of the post to a split harness or webbing WB secured to the athlete's thighs. In this form a restraining load is applied to the legs of the athlete as he or she are training on the treadmill with resulting lateral movement of the load tethering mechanism delayed by the aerodynamic loads on the fabric panel to delay the lateral shift of the tethered structure in order to insure clearance for the other leg.

Figure 4:
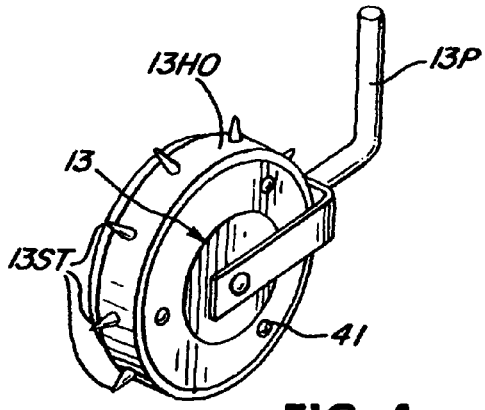
FIG. 4 is a side view of an alternative trailing wheel implementation useful with the instant invention.

The foregoing apparatus has been particularly useful in a steady state exercise arrangement provided within the limited confines of a treadmill. These same limited dimensions, however, of this exercise modality cannot accommodate transitory events like those associated with the starting lunge by a sprinter, the high jump approach transient, toss of a javelin, and the like. These, simply, have to be carried out at the track or field and the limited stationary aspects of this prior arrangement are therefore all resolved in the inventive adaptation described by reference to FIGS. 2 through 4 that now follows.

Figure 2:
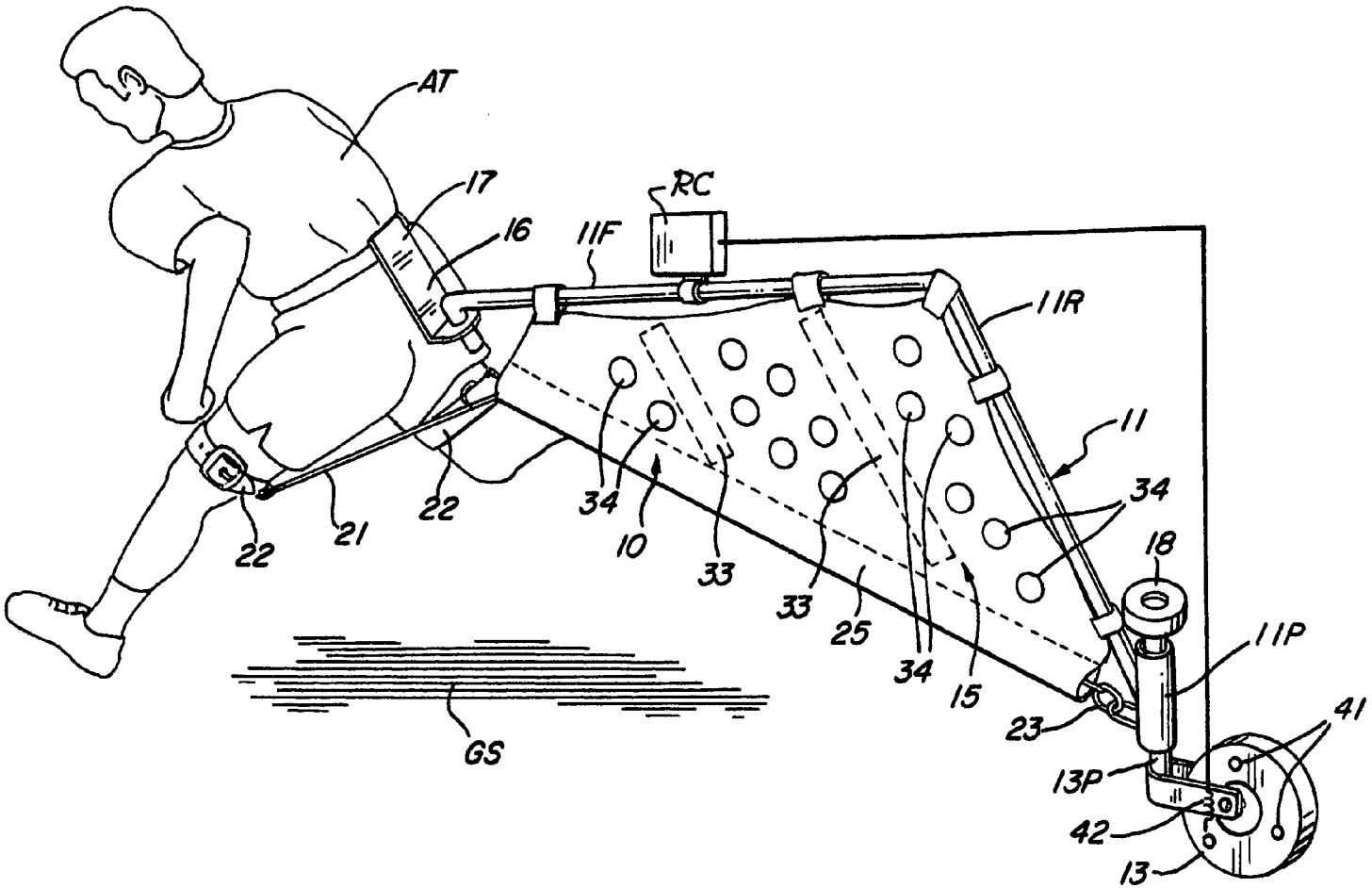
FIG. 2 is a further illustration depicting the instant inventive speed and resistance apparatus in its attached deployment from a person engaged in the process of athletic training.
Figure 3:
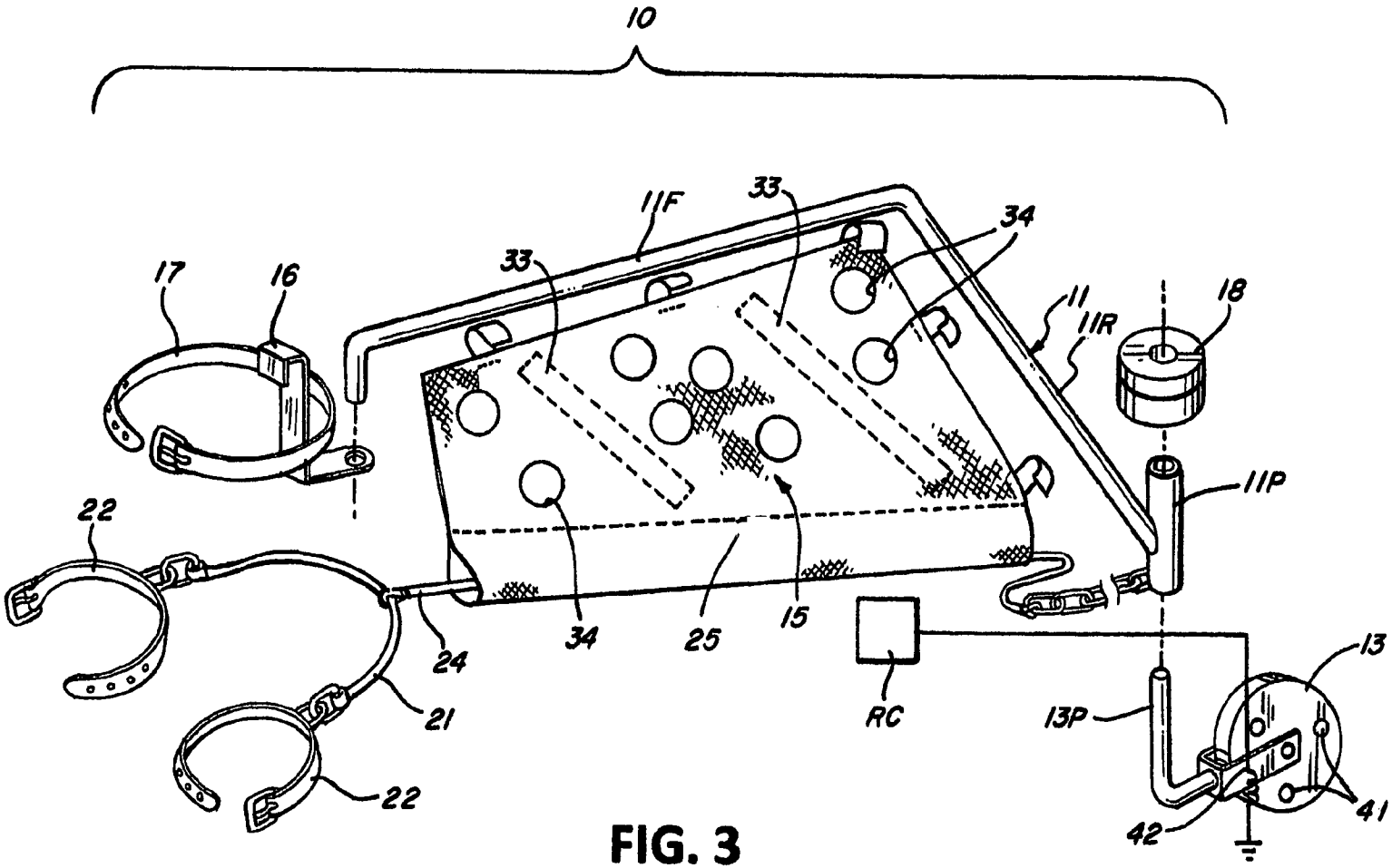
FIG. 3 is yet another perspective illustration, separated by parts, of the inventive speed and resistance apparatus aligned for use.

By particular reference to FIGS. 2 and 3, the inventive speed and resistance apparatus conformed for mobile use, generally designated by the numeral 10, includes a frame 11 defined by a front and rear elongate frame pieces 11F and 11R joined to each other at their proximate ends to define an obtuse angle having the free end of the front piece pivotally engaged in a saddle 16 deployed on a waist belt 17 at the small of the athlete's waist. The other free end of frame 11, in turn, is provided with a vertical pivot bore 11P in which a pivot mount 13P of a trailing wheel 13 is received and loaded by a ballast weight 18 to insure good contact with the ground surface GS. In this manner a trailing structure extending behind the athlete AT is formed as he or she advances along a track or course.

A generally triangular conforming fabric panel 15 is attached along two edges thereof to the respective frame pieces 11F and 11R with the third edge folded over to form a sheath 25 through which an elastomeric band 24 is stretched from the wheel pivot 11P to the midpoint of a split harness 21 comprising a pair of leg straps 22 respectively fastened around the left and right thigh of the athlete AT. A length adjusting chain segment 23 at the end of band 24 is then useful, by selecting the appropriate link for attachment, to adjust the band tension between the attachment end and the harness, thereby setting the desired resistance tension restraining the athlete's leg movement which also stretches the fabric panel 15 to maximize its aerodynamic effect. To enhance even further the aerodynamic drag of the panel as it is trailed behind the athlete AT a set of battens or ribs 33 is sewn into the panel to insure its full planform extension to expose a set of holes 34 to the relative wind, the small forward area of the panel then complying with the lateral movement of the harness 21 with each stride while the path of the larger stretched trailing area remains generally centered on the track.

In this manner a lightweight, aerodynamically stabilized, trailing structure is devised which is supported by a pivoted trailing wheel at its trailing end that is virtually completely attenuated in its lateral excursions. This smoothed result interferes only minimally with the athlete's movement while providing a very stable platform which facilitates accurate measurement for the trainer indicating whether the training should cease because of unwanted localized muscular fatigue. This measurement can be conveniently effected by well known mechanisms, like the measuring mechanism sold under the mark 'Astrale 8' by CatEYE USA, 2300 Central Ave., Unit L, Boulder Colo. 80301 for a bicycle, that are effected by one or more magnetic slugs 41 peripherally spaced on wheel 13 to pass adjacent an inductive pickup 42 fixed on frame 11 which, in turn, is connected to a meter and/or recording device RC also on the frame.

Those skilled in the art will appreciate that the foregoing inventive apparatus is not just limited to athletic endeavors engaged on a field or track. By particular reference to FIG. 4, in which like numbered parts function in a manner similar to that previously described, wheel 13 is provided with a peripherally distributed array of radially projecting studs 13ST mounted on a resilient hoop 13H0 which, when mounted onto the the wheel periphery renders it effective to limit sliding on ice or other slippery surfaces. Thus the inventive apparatus can be rendered useful in settings where contact effected measurement is difficult, like in ice skating, with the primary attenuation obtained by aerodynamic effects and not by mechanical contact.

It will be further appreciated that in each instance both all the parameters that produce resistance loading and also those developing measurement input are completely resolved between the person of the athlete and the trailing end of the frame. This particular aspect allows for convenient size modifications that may even further reduce any potential negative influence on the athlete's movement as noted above.

Obviously many modifications and variations of the instant invention can be effected without departing from the spirit of the teachings herein. It is therefore intended that the scope of the invention be determined solely by the claims appended hereto.

It is claimed:

1. In a training apparatus conformed to provide resistive forces to selected portions of a person's anatomy, and characterized by a fabric panel tethered to the back of said person, the improvement comprising:

a support frame defined by a front and rear elongate piece joined to each other to define an angle therebetween conformed for common engagement to said fabric panel, the free end of said front piece being pivotally engageable to said person to thereby deploy in a trailing alignment the free end of said rear piece;

an elastomeric band attached at one end thereof to said free end of said rear piece and extending through a sheath defined by a lower portion of said panel to engage a pair of limbs of said person at the other end thereof;

rolling means operatively connected to said free end of said rear piece; and measurement means attached to said frame and aligned adjacent said rolling means for producing a record indicative of the rate of motion of said rolling means over ground.

2. Apparatus according to claim 1, wherein:

said rolling means includes a wheel aligned for rolling support on ground.

3. Apparatus according to claim 2, wherein:

said measurement means includes sensing means aligned adjacent said wheel for sensing the turning thereof.

4. Apparatus according to claim 3, wherein:

said frame comprises a front and rear elongate piece joined to each other at an angle; and said panel includes a first and second edge attached respectively to said front and rear pieces and a third edge.

5. Apparatus according to claim 4, wherein:

said fabric panel includes an elongate sheath extending along said third edge thereof; and a portion of said band is received in said sheath.

6. Apparatus according to claim 5, wherein:

said fabric panel includes a plurality of opening formed therein.

7. Apparatus for providing a resistive force to selected limbs of a person in the course of movement by said person along the ground, comprising:

a support frame generally defined by a front and rear elongate piece joined to each other to define an obtuse angle therebetween, the free end of said front piece being pivotally engageable to said person to thereby deploy in a trailing alignment the free end of said rear piece;

a fabric panel attached to said front and rear pieces including a longitudinal sheath extending between said free ends of said front and rear pieces;

an elastomeric band attached at one end thereof to said free end of said rear piece and extending through said longitudinal sheath of said fabric panel to engage a selected pair of limbs of said person at the other end thereof; and rolling means operatively connected to said free end of said rear piece.

8. Apparatus according to claim 7, wherein:

said rolling means includes a wheel aligned for rolling support on ground.

9. Appararatus according to claim 8, wherein:

said measurement means includes sensing means aligned adjacent said wheel for sensing the turning thereof.

10. Apparatus according to claim 9, wherein:

said fabric panel includes a plurality of opening formed therein.

11. Apparatus according to claim 7, further comprising:

an elastic hoop conformed for elastic expansion mounted in a radial alignment on the periphery of said wheel; and a plurality of radially projecting studs fixed to said hoop.

12. Apparatus according to claim 11, wherein:

said fabric panel includes a plurality of opening formed therein.

13. Apparatus according to claim 7, further comprising:

measurement means attached to said frame and aligned adjacent said rolling means for producing a record indicative of the rate of motion of said rolling means over ground.

14. Apparatus according to claim 13, wherein:

said rolling means includes a wheel aligned for rolling support on ground.

15. Appararatus according to claim 14, wherein:

said measurement means includes sensing means aligned adjacent said wheel for sensing the turning thereof.

16. Appararatus according to claim 6, wherein:

said measurement means includes sensing means aligned adjacent said wheel for sensing the turning thereof.

* * * * *